US007095379B2

(12) United States Patent
Pryor et al.

(10) Patent No.: US 7,095,379 B2
(45) Date of Patent: Aug. 22, 2006

(54) RADIO FREQUENCY COMPONENT AND METHOD OF MAKING SAME

(75) Inventors: Mark K. Pryor, San Diego, CA (US); John E. Marks, Escondido, CA (US); Patrick N. Bonebright, San Diego, CA (US); Kenneth Neal Segal, Ellicott City, MD (US); Alan Kogut, Bowie, MD (US)

(73) Assignee: ATK Alliant Techsystems, Inc., Salt Lake City, UT (US)

( * ) Notice: Subject to any disclaimer, the term of this patent is extended or adjusted under 35 U.S.C. 154(b) by 280 days.

(21) Appl. No.: 10/164,990

(22) Filed: Jun. 6, 2002

(65) Prior Publication Data

US 2003/0021928 A1 Jan. 30, 2003

Related U.S. Application Data

(60) Provisional application No. 60/297,867, filed on Jun. 13, 2001, provisional application No. 60/298,038, filed on Jun. 13, 2001, provisional application No. 60/297,928, filed on Jun. 13, 2001, provisional application No. 60/296,889, filed on Jun. 9, 2001, provisional application No. 60/254,975, filed on Jun. 9, 2001, and provisional application No. 60/296,891, filed on Jun. 9, 2001.

(51) Int. Cl.
*H01Q 13/00* (2006.01)

(52) U.S. Cl. ..... 343/786; 343/772; 343/774

(58) Field of Classification Search ..... 343/786, 343/772, 774, 776
See application file for complete search history.

(56) References Cited

U.S. PATENT DOCUMENTS 3,914,861 A * 10/1975 Phillips ..... 343/786
4,089,004 A * 5/1978 Barthlome ..... 343/786
4,408,208 A * 10/1983 Dumas ..... 343/786

OTHER PUBLICATIONS

Declaration of Mark K. Pryor, John E. Marks, and Partick N. Bonebright (see attached Declaration).

* cited by examiner

*Primary Examiner*—Hoang V. Nguyen
(74) *Attorney, Agent, or Firm*—Duckor Spradling & Metzger; Bernard L. Kleinke

(57) ABSTRACT

An electrical component and a method of constructing it are disclosed. The component includes a hollow tubular structure. The structure includes a series of axially spaced apart rings and at least one outer perimeter housing member. The housing member interconnects the rings for defining an internal configuration of the hollow tubular structure for electrical purposes. The rings and the housing member each include inter-engageable elements for helping secure mechanically the rings and housing member together to facilitate final assembly of the electrical component.

22 Claims, 8 Drawing Sheets

RADIO FREQUENCY COMPONENT AND METHOD OF MAKING SAME

RELATED APPLICATION

This application is related to, and claims priority under 35 U.S.C. §119(e) of, the following U.S. provisional applications:

1. Serial No. 60/296,891, titled "FEED HORN", filed Jun. 9, 2001;
2. Serial No. 60/254,975, titled "SLANTED WALL FEED HORN", filed Jun. 9, 2001;
3. Serial No. 60/296,889, titled "VERTICAL WALL FEED HORN", filed Jun. 9, 2001;
4. Serial No. 60/297,928, titled "RING HORN CONSTRUCTION AND METHOD", filed Jun. 13, 2001;
5. Serial No. 60/298,038, titled "SLANTED WALL FEEDHORN", filed Jun. 13, 2001;
6. Serial No. 60/297,867, titled "VERTICAL WALL FEEDHORN", filed Jun. 13, 2001;

each of which is hereby incorporated by reference in their entirety.

The U.S. Government has at least partially funded this invention pursuant to the terms of contract/purchase order number S-35026-G awarded by NASA.

BACKGROUND OF THE I,NVENTION

1. Field of the Invention

The invention relates to electrical components. In particular, the invention relates to radio-frequency components and their assembly.

2. Related Art

The information contained in this section relates to the background of the art of the present invention without any admission as to whether or not it legally constitutes prior art.

Various methods have been employed for assembling of components for spacecraft and other applications. For example, reference may be made to the following U.S. patents:

| U.S. Pat. NO. | INVENTOR | ISSUE DATE |
|---|---|---|
| 4,397,434 | Farnham | Aug. 9, 1983 |
| 4,875,795 | Anderson | Oct. 24, 1989 |
| 5,535,295 | Matsumoto | Jul. 9, 1996 |
| 5,724,051 | Mailandt et al. | Mar. 3, 1998 |
| 5,803,402 | Krumweide et al. | Sept. 8, 1998 |
| 5,849,204 | Matsumoto | Dec. 15, 1998 |
| 6,046,704 | Lopez | Apr. 4, 2000 |
| 6,064,969 | Haskins | May 16, 2000 |
| 6,148,740 | Jackel et al. | Nov. 21, 2000 |
| 6,307,451 B1 | Saitoh et al. | Oct. 23, 2001 |

Electrical components such as feedhorns, wave guides, adapters and others have been used in spacecraft and other applications. Feedhorns, for example, are used to obtain and direct radio frequency (RF) energy reflected from a satellite dish. Feedhorns used in space require an unusual combination of low weight, structural stiffness, and thermal stability, which are difficult to achieve simultaneously. Certain feedhorns are generally made of a metal that is machined. For example, some early structures were fabricated from metals such as aluminum or light alloys resulting in a heavy structure. Since the overall weight of a spacecraft is constrained by the payload capabilities of a given launch vehicle, a relatively heavy structure resulted in a reduction of onboard equipment and instrumentation that could be included in the satellite. The emphasis therefore is to make future spacecraft lighter, faster and less expensive.

It is desirable that the feedhorn have sufficient structural strength and stiffness because the satellite must be able to withstand forces imparted during launch without permanent deformation. A feedhorn lacking sufficient strength and stiffness, even if it is low weight, may not survive the launch process. Thermal stability is another important parameter in feedhorn design because the feedhorn is often exposed to extremes of temperature caused by the difference in heat load between the sunlit side and the shadow side of the spacecraft. The materials and construction methods used to construct the feedhorn need be capable of providing a foundation that will not bend or distort under these different temperature loadings. Minuscule distortions sufficient to negatively affect critical alignment can occur that may render a scientific payload inoperable. Moreover, the trend to further lighten payloads by fabricating much of the payload hardware from composite materials has increased the need to achieve a better thermal match between the payload hardware and the spacecraft.

Traditional metallic feedhorns are machined from a solid block of metal. These are heavy in weight as compared to composite material feedhorns and are difficult to fully optimize due to limitations of machining thin walls. Thus, previously manufactured composite feedhorns have been formed from individual piece parts held in-place with assembly tooling that are then adhesively bonded together. The elements are generally held together using the tool or fixture during the bonding process. The bonding process must be performed with the tool generally obstructing easy access to some areas, resulting in a cumbersome and expensive bonding and manufacturing process. The tools used to assemble the feedhorn can be expensive and even obtrusive to regions within the feedhorn where the tooling exists, which can make bonding the assembly together awkward and time consuming.

U.S. Pat. No. 5,803,402, to Krumweide, discloses a method of assembling a spacecraft framework using structural components held together with little or no tools or fixtures required to hold the components during the bonding process. The components may then be bonded together in a rigid configuration.

There is a need for a low cost method of producing spacecraft feedhorns and other electrical components that are strong, rigid, lightweight, and thermally stable to meet the rigors of outer space. These types of components generally require close tolerances, as may be the case for RF components such as antennae. For example, close tolerances in the surface configuration and shape may be critical in these components.

BRIEF DESCRIPTION OF THE DRAWINGS

In the following, the invention will be explained in further detail with reference to the drawings, in which.

DESCRIPTION OF CERTAIN EMBODIMENTS OF THE INVENTION

Figure 1A:
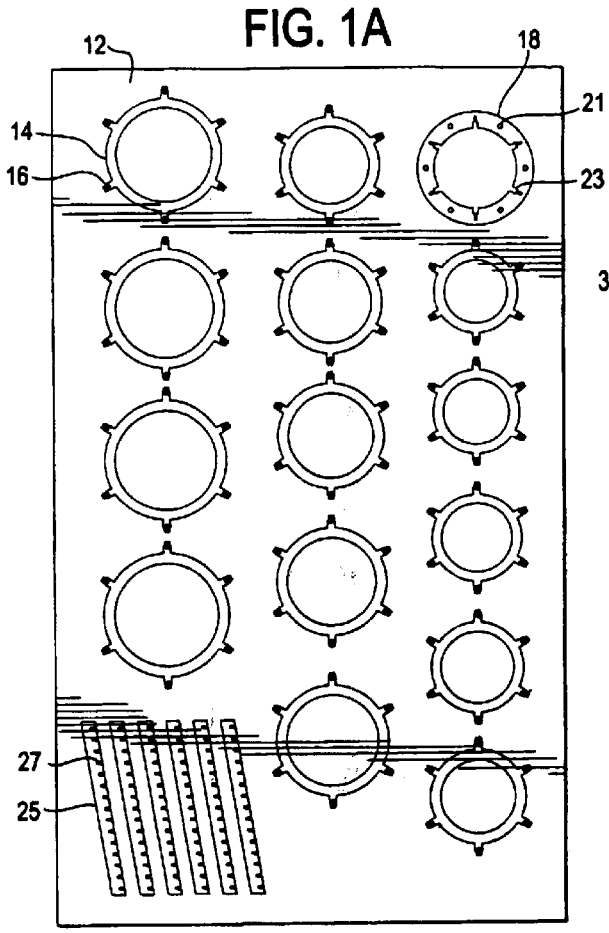
FIG. 1A is a plan view depicting a blank of components on a flat sheet of graphite fiber reinforced plastic laminate in an embodiment according to the present invention.

FIG. 1A shows a plan view of a blank 12 including a flat laminate sheet. The sheet may be made of a lightweight carbon fiber reinforced polymer (CFRP) composite material. The blank 12 has formed on it a plurality of rings, such a ring 14, and a plurality of ribs, such as rib 25, to be cut out from the blank 12.

In the embodiment illustrated in FIG. 1A, fourteen rings are formed to be cut from the blank 12. In an embodiment, the rings each have a different diameter, ranging from smallest to largest. Each ring, such as ring 14, is provides with a plurality of ring appendages, such as appendage 16. In the embodiment illustrated in FIG. 1A, each ring is provided with six appendages to match the number of ribs provided.

An additional bottom ring 18 is also formed on the blank 12. The bottom ring 18 is provided with a plurality of mounting holes 21 for allowing the assembled feedhorn to be mounted. The bottom ring 18 is also provided with a plurality of rib-mounting notches, such as notch 23. The rib-mounting notch 23 is adapted to accommodate a lower end of a rib, such as rib 25, during assembly.

The embodiment illustrated in FIG. 1A also includes six ribs, such as rib 25, to be cut from the same blank 12. The ribs are identical in size and shape to each other. Each rib is provided with a plurality of rib slots, such as slot 27, adapted to interlock with corresponding slots formed on the ring appendages, as described in further detail below.

The layout of the rings and the ribs on the blank 12, as shown in FIG. 1A, can be designed in various manners using manual techniques or using computer aided design and computer aided manufacturing techniques known to a person skilled in the art. The layout may be designed such that the available area of the blank 12 is efficiently utilized.

Figure 1B:
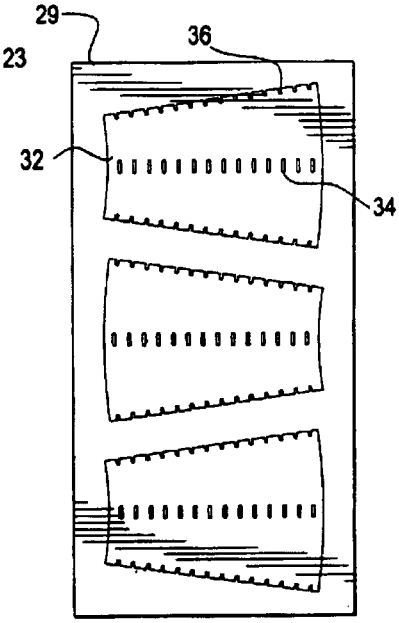
FIG. 1B is a plan view depicting a blank of outer skins on an additional flat sheet of graphite fiber reinforced plastic laminate.

FIG. 1B shows a plan view of a second blank 29 from which a plurality of skin sheets, such as skin sheet 32, may be cut out. As shown in FIG. 1B, the skin sheets are substantially identical to each other in size and shape. In the embodiment illustrated in FIG. 1B, three skin sheets are provided. Each of the skins has a plurality of centerline holes, such as hole 34, and a plurality of edge slots, such as slot 36, on opposite edges. The centerline holes are adapted to allow the ring appendages, such as appendage 16 illustrated in FIG. 1A, to pass through. Each edge slot is approximately one-half the size of the centerline holes. Thus, when two skin sheets are placed side-by-side, corresponding edge slots on the two sheets form a single slot that is approximately the same size and shape as a centerline hole.

In an embodiment, the blank 29 in FIG. 1B also comprises a lightweight CFRP composite material suitable for spacecraft applications. In an embodiment, all of individual components of the feed horn can be cut from flat laminate sheets of composite materials in a simplified manufacturing process which results in greatly reduced cost compared to conventional manufacturing techniques which would require precision molds to process curved laminate parts. Furthermore, by using flat laminate sheets instead of curved laminate parts, significant cost savings can be achieved by efficiently utilizing the available surface areas of expensive composite laminate sheets.

Figure 2A:
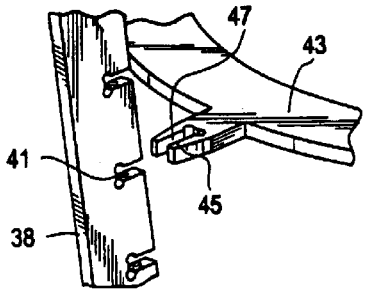
FIGS. 2A and 2B are perspective views depicting self-fixturing features of constituent parts.
Figure 2B:
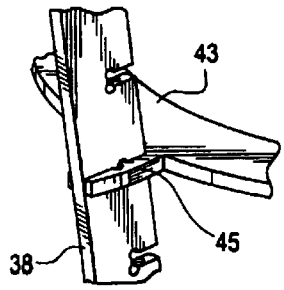

FIGS. 2A and 2B show partial perspective views of a rib 38 and a ring 43. The rib 38 has a plurality of rib slots, such as rib slot 41. The rib slot 41 is aligned with a slot 47 in a ring appendage 45 of the ring 43. The rib slot 41 is a vertical slot, while the ring appendage slot 47 is a horizontal slot. Once the slots 41, 47 are in alignment with each other, the rib 38 is pushed toward the ring 43 to interlock the slots 41, 47, as most clearly illustrated in FIG. 2B. Other slots in the rib 38 are aligned and interlocked with corresponding slots of appendages of other rings. Similarly, slots on other ribs may be aligned and interlocked with the remaining appendages on the ring 43.

Figure 3:
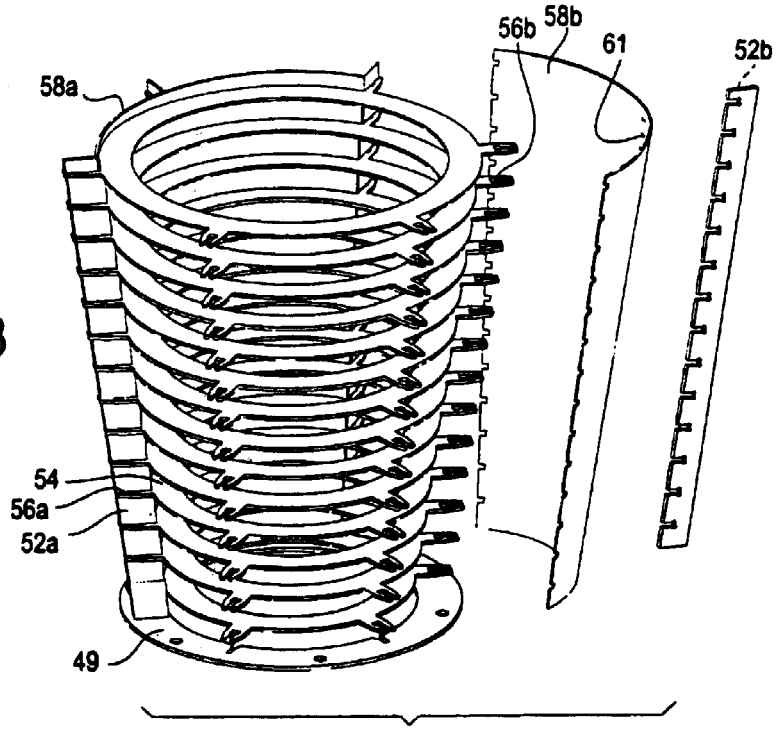
FIG. 3 is a perspective view depicting an intermediate step in the construction in an embodiment according to the present invention.

FIG. 3 shows a perspective view of multiple sections of an assembly during the assembling process. A bottom ring 49 is provided to secure one or more ribs, such as rib 56*a*. In one embodiment, three alternating ribs may be first secured to the bottom ring 49. With at least some of the ribs in place, a plurality of rings, such as ring 54, may be secured in to the ribs by interlocking rib slots with slots on ring appendages, such as ring appendage 56*a*, as described above with reference to FIGS. 2A and 2B. In one embodiment, the rings are secured in a vertically spaced-apart configuration. Further, the rings are order such that the smallest ring is closest to the bottom ring 49.

With each ring in its corresponding position, skin sheets, such as skin sheets 58*a*, 58*b*, may be mounted. In FIG. 3, the centerline holes in the skin sheets, such as centerline hole 61, are aligned with the ring appendages, such as appendage 56*b* before the skin sheet is attached to the assembly. The edge slots on the edges of the skin sheets are aligned with adjacent columns of ring appendages, which may be interlocked with a rib. As described above with reference to FIG. 1B, the centerline holes and the edge slots on the skin sheets are sized for a tight fit with corresponding ring appendages on the assembly. With the skin sheet in place, the skin sheet may be secured by a rib, such as rib 52*b*, being secured to the rings by interlocking its rib slots with corresponding ring appendage slots protruding through the centerline holes of the skin sheet.

Figure 4:
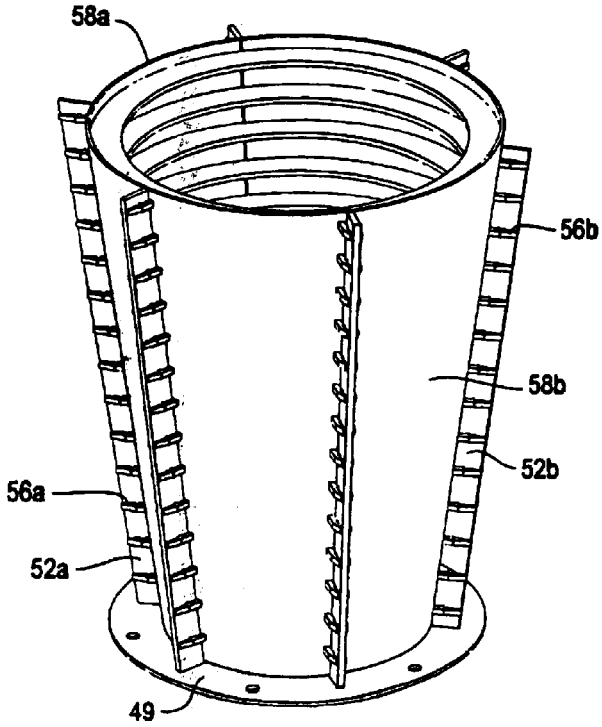
FIG. 4 is a perspective view depicting a final stage of assembly in an embodiment according to the present invention.

FIG. 4 shows a perspective view of an assembled feedhorn in an embodiment according to the present invention, after all of the skin sheets and the ribs are attached to the assembly. In this embodiment, the feedhorn is of a generally frusto-conical configuration and comprises three skin sheets, such as sheets 58*a*, 58*b*, and six equally spaced-apart ribs, such as ribs 52*a*, 52*b*, around the perimeter of the assembly.

Figure 5:
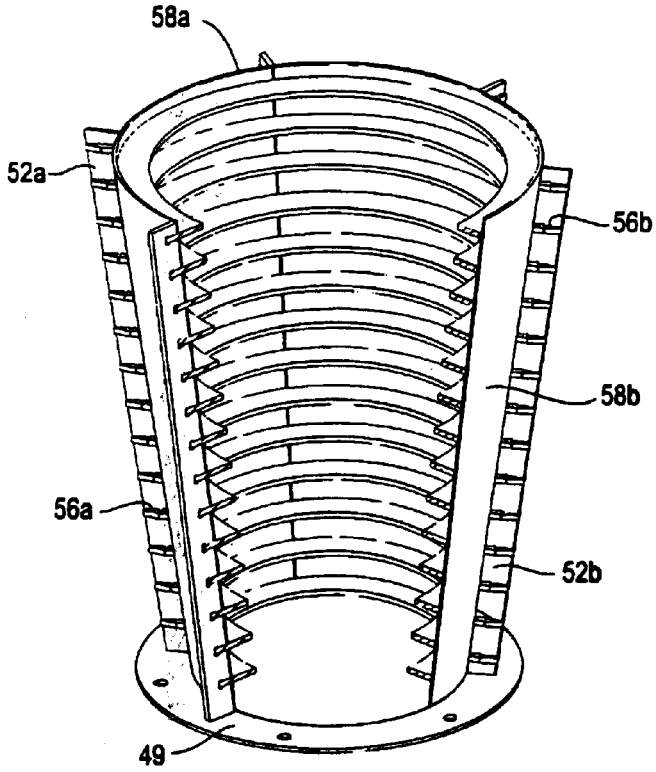
FIG. 5 is a cut away perspective view depicting a final stage of assembly in an embodiment according to the present invention.

FIG. 5 is a cutaway perspective view of the feedhorn of FIG. 4, showing the vertically tapered interior walls of the feedhorn with spaced-apart rings, as well as the slanted exterior walls formed by the skins sheets surrounding the multiple sections of the assembly. Generally, the internal configuration of the feedhorn is electrically significant.

Figure 6:
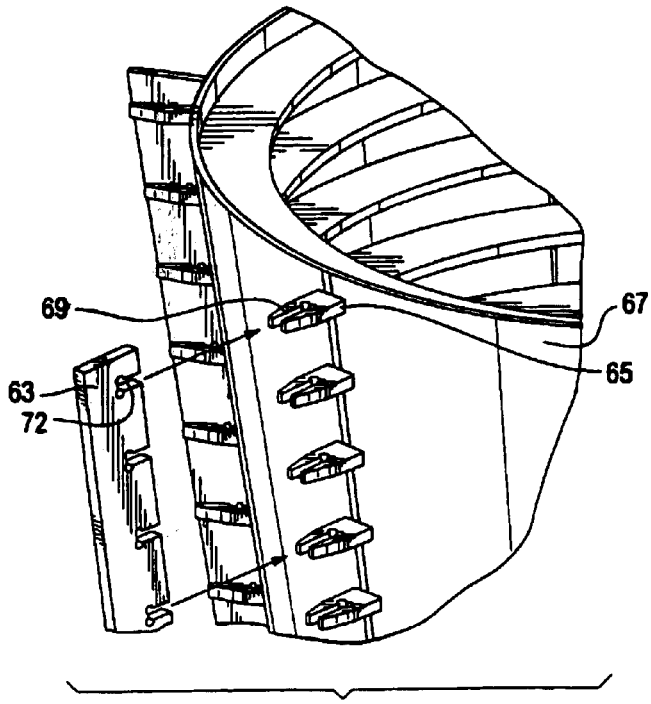
FIG. 6 is a partial perspective view of a feed horn in an embodiment according to the present invention.

FIG. 6 shows a partial perspective view of a feedhorn in an embodiment according to the present invention, illustrating the attachment of a rib 63 to ring appendages, such as appendage 65, after the skins, such as skin 67, are attached to the assembly. The edge slots at the edges of the skins and the centerline holes are shaped to allow the ring appendages to protrude from the outer wall found by the skins. In an embodiment, the ring appendages have slots, such as slot 69, while the rib 63 has corresponding slots, such as slot 72, which are sized and shaped for a tight fit with the appendage slots. The slots in the rib 63 are aligned with the slots in the corresponding ring appendages before the rib 63 is pushed toward the ring appendages to hold the skins tightly against the assembly.

Although the illustrated embodiment includes each ring being made of a single segment, it will be appreciated by those skilled in the art that rings may be made of multiple segments that are subsequently assembled prior to completion of the feedhorn assembly.

In a quality control process, a dimensional inspection may be made to the structure to ensure that all of the elements are in their correct locations and orientations. Bonding of the structure may take place when each section of the assembly is constructed or when all of the elements including multiple sections of the assemblies and the ribs are attached together. In an embodiment, the components are bonded together by using a conventional adhesive for CFRP composite materials and cured at room temperature to complete the feed horn structure. Once the pieces are fitted together, they may be tacked in place using capillary adhesives such as Hysol 956 or 9396, available from E. v. Roberts & Associates, Culver City, Calif. Alternatively, adhesive can be wicked to fill 100% of the faying surfaces between the joints. Once the unit is assembled, fillets can be formed on each side of the joint using a structural adhesive. In addition, the finalized feedhorn can be sprayed or plated with a metallic coating to increase conductivity of the inner portions of the feedhorn. This design and construction technique provides a structure that is mission adaptable, that is low cost, and that permits last-minute changes to the structure with little difficulty or cost. It is apparent that an embodiment of the present invention lends itself to a wide range of possible sizes and configurations.

Figure 7A:
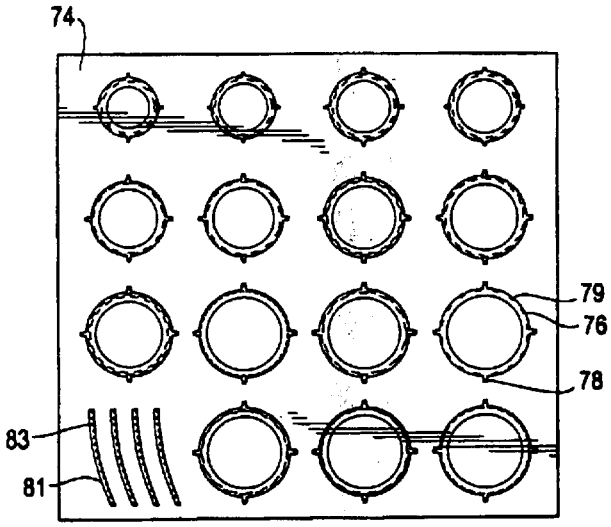
FIG. 7A is a plan view depicting a blank of rings and ribs on a flat sheet of graphite fiber reinforced plastic laminate in an embodiment according to the present invention.

FIG. 7A shows a plan view of a blank 74, preferably of a lightweight CFRP composite material, from which a plurality of rings, such as ring 76, and a plurality of ribs, such as rib 81 are cut out in an embodiment according to the present invention.

In the embodiment illustrated in FIG. 7A, fourteen rings, such as ring 76, may be cut out from the blank 74. Each ring is provided with a plurality of ring appendages, such as appendage 78. In the embodiment illustrated in FIG. 7A, each ring is provided with four appendages. However, it is understood that any practical number of appendages may be used. Further, each ring is provided with a series of mortises, such as mortise 79. The mortises are sized to accommodate tenons formed on bands, as described below. In an embodiment, the rings each have a different diameter, varying from the smallest to the largest.

In addition, four ribs, such as rib 81, may also be cut from the same blank 74. Each rib is provided with a series of rib slots, such as slot 83. The ribs are generally identical in size and shape to each other.

Figure 7B:
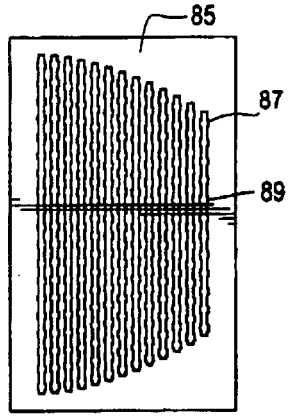
FIG. 7B is a plan view depicting a blank of bands on another flat sheet of graphite fiber reinforced plastic laminate in an embodiment according to the present invention.

FIG. 7B shows a plan view of a second blank 85 from which a plurality of bands, such as band 87, may be constructed. As shown in FIG. 7B, the bands each have a different length and may be cut from the blank 85. Each band is provided with a series of tenons, such as tenon 89. The tenons are sized to tightly fit into the mortises, such as mortise 79 (FIG. 7A), on the rings.

Figure 8:
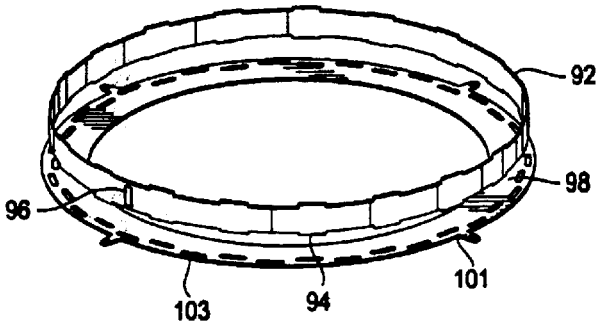
FIG. 8 is a perspective view depicting self-fixturing features of a ring and a band.

FIG. 8 shows a perspective view of a self-fixturing ring-and-band assembly constructed by using a ring 98 cut from a blank, such as the blank 74 of FIG. 7A, and a corresponding band 92 cut from a blank, such as the blank 85 of FIG. 7B. In FIG. 8, the band 92 is formed by bending one of the flat bands cut from the blank and connecting the ends of the band 92 with, for example, a bonded doubler 96 to form a circular band.

In other embodiments, a doubler may not be required if, for example, the bands are pre-formed as endless loops. In still other embodiments, each band may include several segments that are assembled using a plurality of doublers, for example.

In an embodiment, the band 92 is provided with a plurality of tenons, such as tenon 94, for attachment to the ring 98. As shown in FIG. 8, the ring 98 has four equally spaced-apart ring appendages, such as appendage 101, each having a slot for engagement with a rib to form a rigid structure. In addition, the ring 98 has a plurality of mortises, such as mortise 103 adjacent to the perimeter of the ring for receiving the tenons of the band 92.

Figure 9:
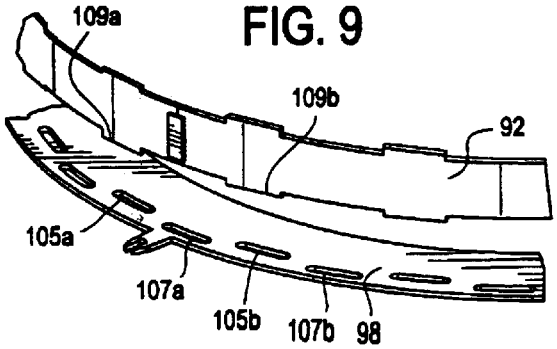
FIG. 9 is a perspective view depicting a portion of the ring and band of FIG. 8 illustrating an intermediate step in the construction of one embodiment of the present invention.

FIG. 9 shows a perspective view of a portion of the ring-and-band assembly of FIG. 8, illustrating detailed features of the ring and the band in the construction of the self-fixturing ring-and-band assembly. In FIG. 9, the ring appendage 101 of the ring 98 has a slot for receiving a corresponding rib slot of a rib, similar to that described below with reference to FIGS. 11A and 11B. In FIG. 9, the tenons on the band 92, such as tenons 109*a*, 109*b*, are aligned with corresponding mortises in the ring 98 and inserted into the corresponding mortises to form the ring-and-band assembly. The mortises in the ring and the tenons on the wrap are sized for a tight fitting to produce a rigid ring and wrap assembly structure. Two sets of mortises may be provided on each ring. For example, a set of upper mortises, such as mortises 107*a*, 107*b*, may be positioned to receive an upper band, such as band 92, and a set of lower mortises, such as mortises 105*a*, 105*b*, may be positioned to receive a lower band which may be of a smaller diameter, thus requiring the lower mortises to be positioned slightly inward of the upper mortises.

Figure 10:
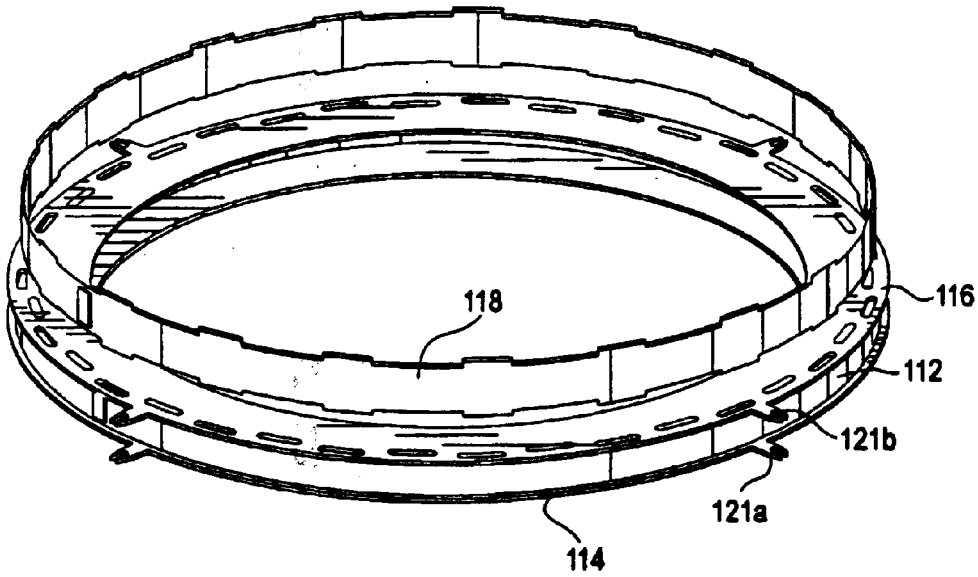
FIG. 10 is a perspective view depicting two sections of the self-fixturing ring and band assembly.

FIG. 10 shows a perspective view illustrating the assembly of two sections of rings and bands in an embodiment according to the present invention. In FIG. 10, a first ring-and-band assembly is formed by aligning and inserting the tenons on one side of the band 112 into the corresponding mortises in the ring 114. The band 112, which has tenons on both sides, is also capable of being attached to a second ring 116. An additional band 118 is attached to the second ring 116. The ring appendages, such as appendage 121*a*, on the ring 114 and the ring appendages, such as appendage 121*b* on the ring 116 are in alignment with each other for rib assembly. Additional sections of rings and bands can be assembled in a similar manner to form a microwave or RF feedhorn structure.

Figure 11A:
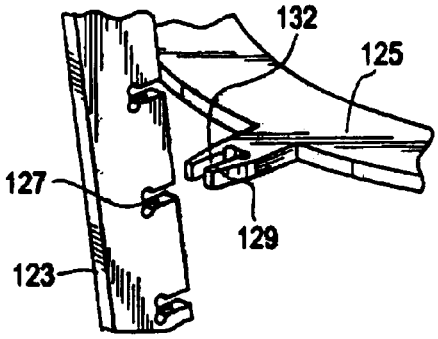
FIGS. 11A and 11B are perspective views depicting a stage of assembly in an embodiment according to the present invention.
Figure 11B:
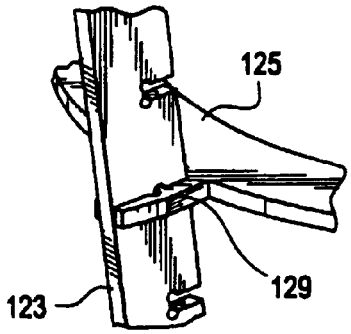

FIGS. 11A and 11B show partial perspective views of a rib 123 and a ring 125. The rib 123 has a plurality of rib slots, such as rib slot 127. The rib slot 127 is aligned with a slot 132 in a ring appendage 129 of the ring 125. The rib slot 127 is a vertical slot, while the ring appendage slot 132 is a horizontal slot. Once the slots 127, 132 are in alignment with each other, the rib 123 is pushed toward the ring 125 to interlock the slots 123, 125, as most clearly illustrated in FIG. 11B. Other slots in the rib 123 are aligned and interlocked with corresponding slots of appendages of other rings. Similarly, slots on other ribs may be aligned and interlocked with the remaining appendages on the ring 125.

Figure 12:
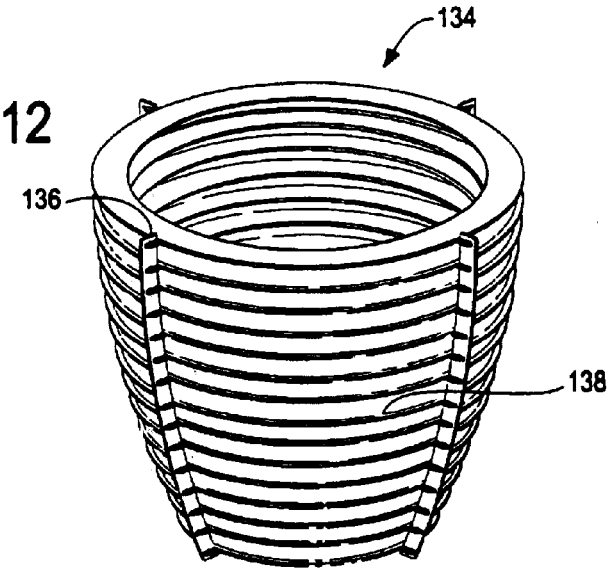
FIG. 12 is a side perspective view of an assembled vertical wall feedhorn according to an embodiment of the present invention.
Figure 13:
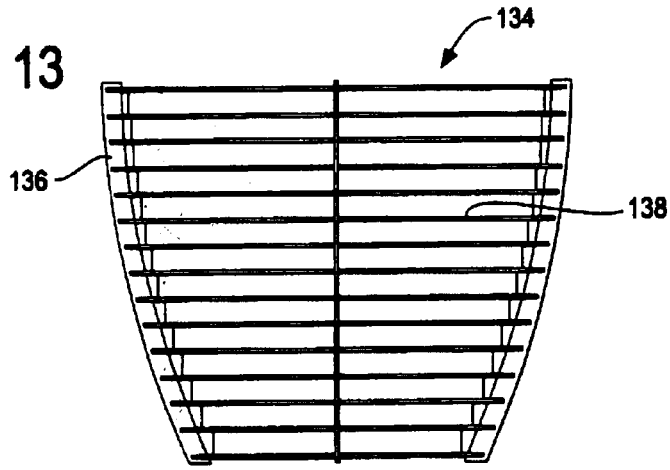
FIG. 13 is a side view of the assembled vertical wall feedhorn of FIG. 12.
Figure 14:
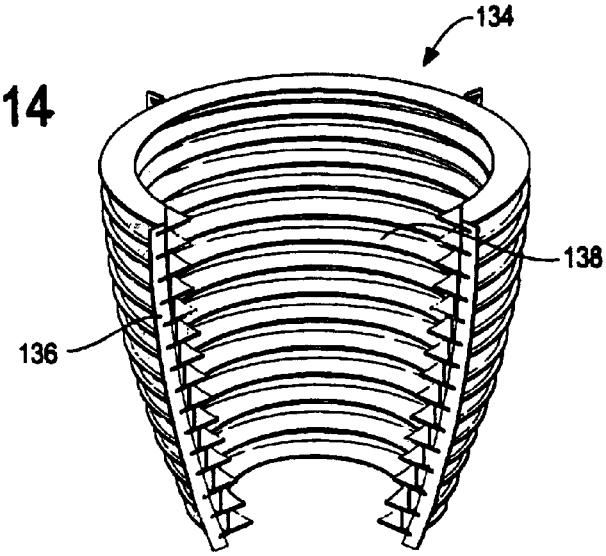
FIG. 14 is a cut-away perspective view of the assembled vertical wall feedhorn of FIGS. 12 and 13.

FIGS. 12–14 show perspective, side-sectional and cutaway perspective views of a vertical wall feedhorn assembly 134 according to an embodiment of the present invention. The assembly 134 is of a generally frusto-bullet-shaped configuration with four equally spaced ribs, such as rib 136, holding multiple sections of rings, such as ring 138, and bands together to form a rigid feed horn structure.

FIG. 14 is a cutaway perspective view of the feedhorn of FIGS. 12 and 13, showing the interior walls of the feedhorn with spaced-apart rings. Generally, the internal configuration of the feedhorn is electrically significant.

Figure 15A:
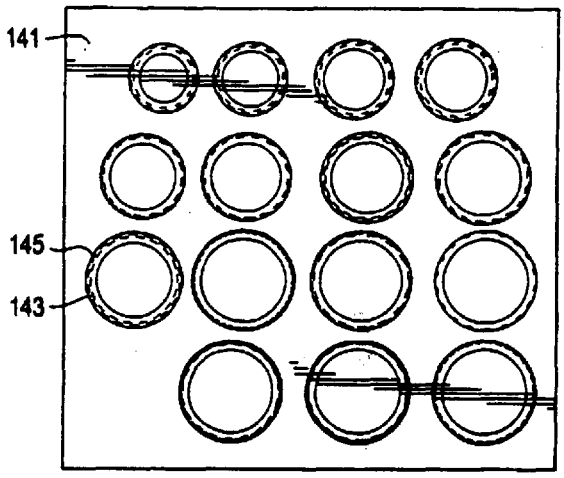
FIG. 15A is a plan view depicting a blank of rings on a flat sheet of graphite fiber reinforced plastic laminate in an embodiment according to the present invention.

FIG. 15A shows a plan view of a blank 141, preferably of a lightweight CFRP composite material, from which a plurality of rings, such as ring 143, may be cut out, for example, for a vertical wall feed horn in an embodiment according to the present invention. In the embodiment illustrated in FIG. 15A, fifteen rings, such as ring 143, may be cut out from the blank 141. Each ring is provided with a series of mortises, such as mortise 145. The mortises are sized to accommodate tenons formed on bands, as described below. In an embodiment, the rings each have a different diameter, varying from the smallest to the largest.

Figure 15B:
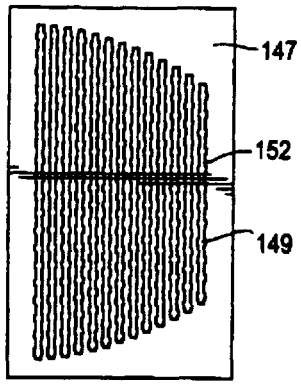
FIG. 15B is a plan view depicting a blank of bands on another flat sheet of graphite fiber reinforced plastic laminate in an embodiment according to the present invention.

FIG. 15B shows a plan view of a second blank 147 from which a plurality of bands, such as band 149, may be constructed. As shown in FIG. 15B, the bands each have a different length and may be cut from the blank 147. Each band is provided with a series of tenons, such as tenon 152. The tenons are sized to tightly fit into the mortises, such as mortise 145 (FIG. 15A), on the rings.

Figure 16:
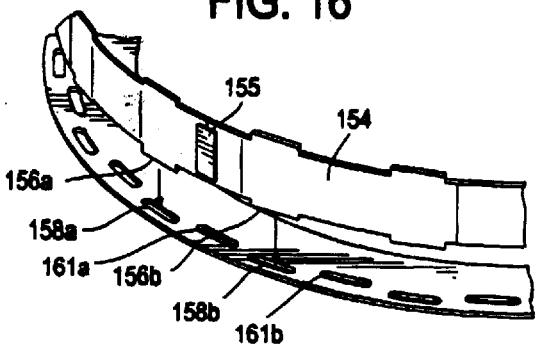
FIG. 16 is a perspective view depicting the self-fixturing features of a portion of a ring and band illustrating an intermediate step in the construction of one embodiment of the present invention.

FIG. 16 shows a perspective view of a portion of a ring-and-band assembly using the ring and bands cut out from the blanks illustrated in FIGS. 15A and 15B. FIG. 16 illustrates detailed features of the ring and the band 154 in the construction of the self-fixturing ring-and-band assembly. A band 154 may be formed using one of the bands cut out from a blank, such as blank 147 (FIG. 15B). A doubler 155 may be used to form a circular band. In FIG. 16, the tenons on the band 154, such as tenons 156*a*, 156*b*, are aligned with corresponding mortises in the ring and inserted into the corresponding mortises to form the ring-and-band assembly. The mortises in the ring and the tenons on the wrap are sized for a tight fitting to produce a rigid ring and wrap assembly structure. Two sets of mortises may be provided on each ring. For example, a set of upper mortises, such as mortises 158*a*, 158*b*, may be positioned to receive an upper band, such as band 154, and a set of lower mortises, such as mortises 161*a*, 161*b*, may be positioned to receive a lower band which may be of a smaller diameter, thus requiring the lower mortises to be positioned slightly inward of the upper mortises.

Figure 17:
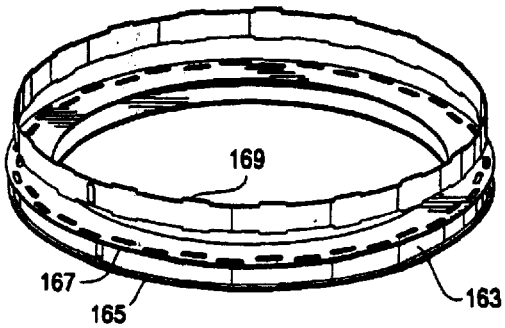
FIG. 17 is a perspective view depicting two sections of the self-fixturing ring and band assembly.

FIG. 17 shows a perspective view illustrating the assembly of two sections of rings and bands in an embodiment according to the present invention. In FIG. 17, a first ring-and-band assembly is formed by aligning and inserting the tenons on one side of the band 163 into the corresponding mortises in the ring 165. The band 163, which has tenons on both sides, is also capable of being attached to a second ring 167. An additional band 169 is attached to the second ring 167. Additional sections of rings and bands can be assembled in a similar manner to form a microwave or RF feedhorn structure.

FIGS. 18–21 show perspective, side-sectional and cutaway perspective views of a feedhorn assembly 172 according to an embodiment of the present invention. The assembly 172 is of a generally frusto-bullet-shaped configuration and includes a series of rings, such as rings 174 and bands 176 assembled in a self-fixturing manner.

Figure 18:
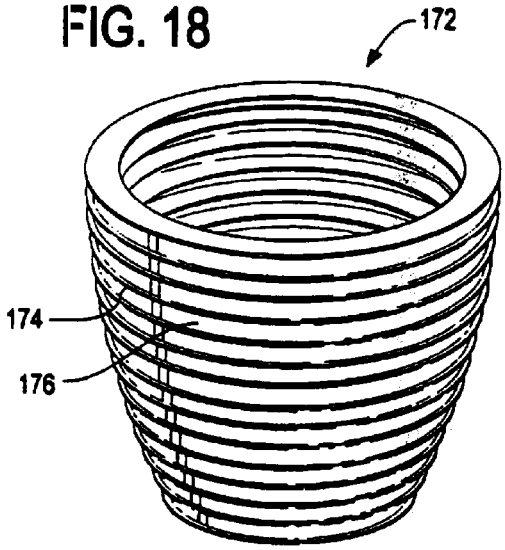
FIG. 18 is a side perspective view of an assembled vertical wall feedhorn according to an embodiment of the present invention.
Figure 19:
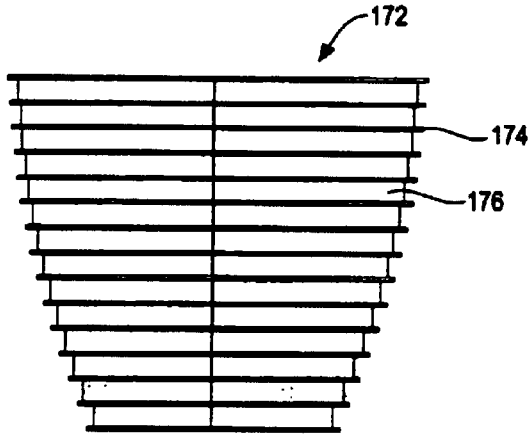
FIG. 19 is a side view of the assembled vertical wall feedhorn of FIG. 18.
Figure 20:
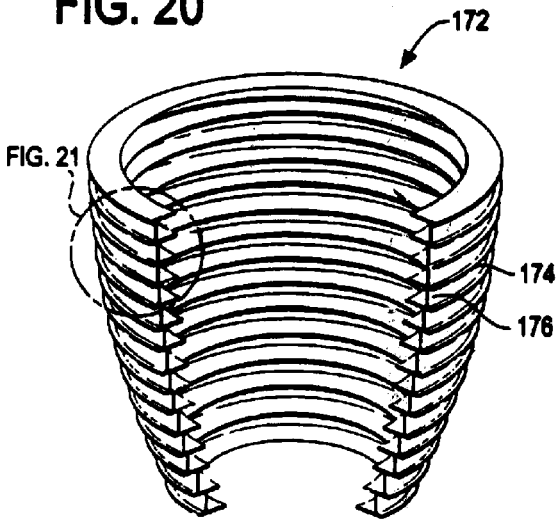
FIG. 20 is a cut-away perspective view of the assembled vertical wall feedhorn of FIGS. 18 and 19.
Figure 21:
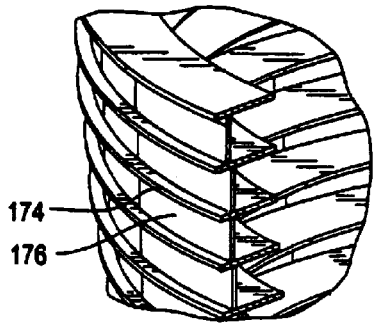
FIG. 21 is a detailed view of a section of the cut-away view illustrated in FIG. 20.

FIGS. 20 and 21 illustrate cutaway perspective views of the feedhorn of FIGS. 18 and 19, showing the interior walls of the feedhorn with spaced-apart rings. Generally, the internal configuration of the feedhorn is electrically significant.

The components of the various embodiments described above may be made of any suitable material. For example, in addition to CFRP, other suitable materials may include metal, alloys such as invar, titanium, silicon carbide (SiC) ceramic, composites such as component matrix composite (CMC), and others.

The various embodiments described above have been illustrated as having a generally circular cross-section. It is noted, however, that any desired cross-section may be achieved by proper shaping of the rings and/or bands. For example, a feedhorn may be assembled having a rectangular, oval, elliptical or other cross-section.

An adapter may be used to connect the base of the feedhorn, which may have a particular cross-section, to a waveguide which may be of a different cross-section. For example, a feedhorn with a circular cross-section may be connected to a waveguide having a rectangular cross-section by using such an adapter.

While particular embodiments of the present invention have been disclosed, it is to be understood that various different modifications and combinations are possible and are contemplated within the true spirit and scope of the appended claims. There is no intention, therefore, of limitations to the exact abstract and disclosure herein presented.

What is claimed is:

1. An electrical component, comprising:

a hollow tubular structure, including a series of axially spaced apart rings, and at least one outer perimeter housing member interconnecting said rings for defining an internal configuration of said hollow tubular structure for electrical purposes;

wherein said rings and said housing member each include inter-engageable elements for helping secure mechanically said rings and housing member together to facilitate final assembly of the electrical component, said inter-engageable elements include a plurality of mortises formed on said rings and a plurality of tenons formed on said housing member.

2. The electrical component according to claim 1, wherein said rings are circular.

3. The electrical component according to claim 1, wherein said rings include a single segment.

4. The electrical component according to claim 1, further comprising:

one or more ribs, each rib engaging said rings for securing said housing member to said rings.

5. The electrical component according to claim 1, wherein said housing member is a band.

6. The electrical component according to claim 1, wherein said housing member is a skin sheet.

7. The electrical component according to claim 1, wherein said each circular band comprises a doubler, said each circular band being formed from a flat band comprising two ends, the doubler joining the two ends.

8. The electrical component according to claim 1, wherein said at least one outer perimeter housing member comprises carbon fiber reinforced polymer.

9. A method of assembling an electrical component, comprising:

a) mounting a housing member to a ring using inter-engaging means to form an assembly;

b) adding an additional ring to said assembly using inter-engaging means;

c) adding an additional housing member to said assembly using inter-engaging means; and d) repeating steps b) and c) until a desired assembly length is achieved.

10. The method according to claim 9, further comprising:

cutting out said rings and a plurality of housing member elements from one or more generally flat blanks, each of said rings and said housing member elements having an inter-engaging means on each end; and deforming said housing member elements to form housing members.

11. The method according to claim 10, wherein said deforming forms a closed loop.

12. The method according to claim 11, wherein said closed loop is secured by a doubler.

13. The method according to claim 9, wherein said inter-engaging means includes mortises formed on said rings and tenons formed on opposing ends of said housing member elements.

14. The method according to claim 9, further comprising:

g) attaching one or more ribs to an outer surface of said assembly.

15. The method according to claim 14, wherein said ribs are attached to said assembly using inter-engaging slots formed on said ribs and on appendages of said rings.

16. An electrical component, comprising:

A hollow tubular structure, including a series of axially spaced apart rings, at least one outer perimeter housing member interconnecting said rings for defining an internal configuration of said hollow tubular structure for electrical purposes; and one or more ribs, each rib engaging said rings for securing said housing member to said rings;

wherein said rings and said housing member each include inter-engageable elements for helping secure mechanically said rings and housing member together to facilitate final assembly of the electrical component, said rings include appendages, said appendages having slots for inter-engaging corresponding slots on said ribs.

17. A method of assembling an electrical component, comprising:

cutting out a plurality of rings, a plurality of ribs, and a plurality of housing member elements from one or more generally flat blanks, each of said rings and said ribs having an inter-engaging means;

mounting at least one rib of the plurality of ribs to a ring of the plurality of rings to form an assembly;

mounting one or more rings of the plurality of rings to said assembly by securing each of said one or more rings to said at least one rib using said inter-engaging means;

deforming said housing member elements to form housing members; and mounting at least one housing member to external perimeters of said rings.

18. The method according to claim 17, further comprising:

mounting at least one additional rib upon said assembly for securing said housing members to said assembly.

19. The method according to claim 18, wherein said mounting at least one additional rib includes engaging said at least one additional rib to appendages of said rings protruding through said housing members.

20. The method according to claim 17, wherein said housing member is a skin.

21. An electrical component, comprising:

a hollow tubular structure comprising a plurality of ring members; and a plurality of circular band members;

wherein:

the ring members are spaced apart by the circular band members along a center axis of the tubular structure;

a plurality of mortises on one of said members and a plurality of tenons on the other one of said members;

the circular band members define an internal configuration of the hollow tubular structure, the internal configuration of the hollow tubular structure including an electrically-conductive surface, each circular band member having a pair of opposite side edges along the center axis so that each side is proximate to a ring member;

the mortises and the tenons are inter-engaged.

22. The electrical component according to claim 21, wherein said each circular band comprises carbon fiber reinforced polymer.

* * * * *